United States Patent [19]

Hall et al.

[11] Patent Number: 4,853,539

[45] Date of Patent: Aug. 1, 1989

[54] GLOW DISCHARGE MASS SPECTROMETER

[75] Inventors: David J. Hall, Middlewich; Neil E. Sanderson, Sandiway; Edward F. H. Hall, Winsford, all of England

[73] Assignee: VG Instruments Group Limited, Crawley, England

[21] Appl. No.: 59,050

[22] Filed: Jun. 8, 1987

[30] Foreign Application Priority Data

Jun. 11, 1986 [GB] United Kingdom ..... 8614177

[51] Int. Cl.[4] ..... H01J 47/00

[52] U.S. Cl. ..... 250/288; 250/281; 250/282; 250/423 R

[58] Field of Search ..... 250/288, 281, 282, 423 R

[56] References Cited

U.S. PATENT DOCUMENTS

| | | | |
|---|---|---|---|
| 3,418,513 | 12/1968 | Elliott | 250/288 |
| 3,770,954 | 11/1973 | Davis | 250/288 |
| 3,798,447 | 3/1974 | Lanusse et al. | 250/281 |
| 4,039,828 | 8/1977 | Pokar et al. | 250/288 |

FOREIGN PATENT DOCUMENTS 2104565 2/1971 Fed. Rep. of Germany .

OTHER PUBLICATIONS

Analytical Chemistry, "Glow Discharge Mass Spectrometry", Feb. 1986, vol. 58, No. 2, pp. 341A–356A, W. W. Harrison et al.

Graham, W. G., "Wall Material and Wall Temperature Effects on Negative Ion Production in a Hydrogen Plasma", Journal of Physics & Applied Physics, vol. 16, No. 10, 10/83, pp. 1907–1915.

T. J. Loving et al., "Dual-Pin Cathode Geometry for Glow Discharge Mass Spectrometry", Anal. Chem., 1983, 55, pp. 1526–1530.

*Primary Examiner*—Carolyn E. Fields
*Assistant Examiner*—John A. Miller
*Attorney, Agent, or Firm*—Chilton, Alix & Van Kirk

[57] ABSTRACT

There is provided a mass spectrometer adapted for the elemental analysis of a sample, especially a solid sample, comprising a glow discharge ion source which yields ions characteristic of the elements in the sample. The background spectrum produced by such a mass spectrometer is substantially reduced by cooling the ion source below 20° C., and preferably below −100° C., thereby increasing the sensitivity and the accuracy of the spectrometer. The cooling of the ion source is preferably accomplished by flowing liquid nitrogen through a heat exchanger disposed in good thermal contact with it.

13 Claims, 5 Drawing Sheets

GLOW DISCHARGE MASS SPECTROMETER

This invention relates to a mass spectrometer adapted for elemental analysis of a sample in which the sample is ionized in a glow discharge.

The principles of operation of such mass spectrometers, and their applications, are described in a review article by W. W. Harrison, K. R. Hess, R. K. Marcus and F. L. King, published in Analytical Chemistry, 1986, vol. 58 (2), pp 341A–356A. In order to determine its elemental composition, a solid sample is introduced into the glow discharge ion source by means of a conventional insertion probe and ions formed in the source which are characteristic of the sample are analyzed by a mass analyzer, preferably one incorporating an energy filter.

Typically the solid sample to be analyzed is made the cathode in a discharge maintained in argon at a pressure of 0.1–10 torr by passing a direct current between the cathode and an anode electrode in the source. Energetic positive ions generated in the discharge are attracted to the negative cathode and strike its surface with sufficient energy to cause sputtering of the sample. Neutral atoms sputtered from the cathode surface enter the region of negative glow in the discharge where there is a large population of energetic argon atoms and electrons, and many of the sputtered atoms are ionized by either electron impact or Penning ionization processes. These ions are extracted from the discharge region and are mass analyzed by a suitable mass analyzer. Preferably a double focusing mass spectrometer is employed because the ions leaving the discharge often have a spread of energies outside the range which can be analyzed by a quadrupole or single-focusing mass spectrometer without an unacceptable loss of performance. Alternatively, a quadrupole mass analyzer preceded by an energy filter such as a cylindrical mirror analyzer can be employed.

The simplest and most convenient form of glow discharge ion source comprises a discharge generated by a direct current passed through argon gas at a pressure of between 0.1 and 10 torr, with the cathode comprising the sample and the body of the ion source comprising the anode. Typically a current of about 1 mA and a potential difference of 0.5–1.0 kV are employed. However, other modes of operation, such as pulsed DC or RF sustained discharges, have also been used. Pulsed DC systems can allow the production of more energetic argon atoms whilst RF sustained discharges facilitate the analysis of non-conducting samples.

A variety of forms of cathode have been employed. Typically, a metallic sample is formed into a small rod which is located in the ion source on an insertion probe. Other forms of cathode, e.g. a disc cathode or a hollow cathode, have been described.

It is found that when a sample is ionized with a glow discharge ion source of the type described, the mass spectrum of the ions formed largely comprises peaks characteristic of the elements present in the sample. Further, the intensity of the peaks remains substantially constant while the sample composition is constant. The technique is therefore suitable for determining the elemental composition of a sample.

In the case of certain elements, however, the sensitivity is significantly reduced by the presence of interfering peaks at or close to the mass being monitored. These interfering peaks have their origins in a variety of ways.

Some, such as $Ar^+$, $Ar_2^+$ and $Ar^{++}$, etc, are due to the argon gas itself, or the reactions of Ar and $Ar^+$ with impurities present in the gas or in the ion source. A peak due to $ArH^+$, generated by the reaction of argon ions with hydrogen-containing impurities, is frequently very large. Other interfering peaks may be due to the ionization of material sputtered from the sample holder, which may contain insulating materials, or directly by the ionization of impurities such as carbon, hydrogen, nitrogen, water, or vacuum pump oil which are always present to some extent in the source. In particular, the interferences due to water are especially troublesome. See, for example, T. J. Loving and W. W. Harrison, Analytical Chemistry, 1983, vol. 55. pp 1526–1530. It has been shown that the presence of water not only results in the appearance of large peaks due to $H^+$, $H_2^+$, $O^+$, $H_2O^+$, $OH^+$, and $H_3O^+.nH_2O$, but also causes a considerable reduction in the sputter rate of the sample, thereby reducing the intensity of the peaks characteristic of the elements comprising the sample. Consequently, great care has to be taken to reduce substantially impurities (especially water) in the argon gas and in the sample.

In organic mass spectroscopy it is conventional to heat the ion source during operation to prevent the condensation of materials such as water and vacuum pump oil, etc, in the ion source and the consequent increase in the intensity of the background spectrum due to their presence. Although additional heating is not usually provided, the power dissipated in a typical glow discharge source is sufficient to heat it to 100° C. or higher. As explained by Loving and Harrison, it has been found that heating the glow discharge ion source does not eliminate the problem of suppression of the sputter rate by water. Only prolonged pumping of the ion source is able to reduce the water vapour concentration to a level low enough to substantially eliminate the problem. Consequently, in the frequently encountered case of a mass spectrometer in which the sample is introduced into the ion source in an insulated sample holder on an insertion probe, adequate performance can only be achieved if the ion source is pumped for a long period after the sample has been introduced, which seriously limits the rate at which samples can be analyzed without compromising the sensitivity. Even after 30 minutes pumping, the effect of water on the glow discharge source is still significant (see FIG. 7 in the paper by Loving and Harrison), and the sensitivity is significantly reduced, especially for iron samples.

It is the object of the present invention, therefore, to provide a mass spectrometer adapted for the elemental analysis of a sample and which comprises a glow discharge ion source in which in comparison with previously known mass spectrometers the suppression effect of certain impurities and the intensity of at least some of the background peaks are both substantially reduced.

It is a further object of the invention to provide a method of elemental analysis of a sample using a mass spectrometer having a glow discharge ion source in which the intensity of at least some background peaks and the suppression effect of certain impurities are both substantially reduced in comparison with previously known methods.

Thus according to one aspect of the invention there is provided a mass spectrometer adapted for the elemental analysis of a sample, comprising:

(a) a substantially enclosed chamber bounded by a wall and having an inlet through which a gas may be introduced and an aperture through which ions formed within it may leave;

(b) means for introducing a solid sample into said chamber;

(c) first electrode means disposed in said chamber remote from said sample;

(d) second electrode means comprising said sample;

(e) means for establishing a glow discharge between said first and second electrode means;

(f) means for extracting from said chamber and subsequently mass analyzing at least some of the ions formed in said glow discharge which are characteristic of elements in said sample; and (g) means for maintaining at least a part of said wall and/or said sample at a temperature substantially below 20° C.

According to another aspect of the invention there is provided a method of elemental analysis of a sample, comprising:

(a) introducing said sample into a chamber containing a gas;

(b) establishing a glow discharge in the gas in said chamber adjacent to said sample and causing particles present in said discharge to bombard said sample;

(c) extracting from said chamber at least some of the ions formed in said discharge which are characteristic of the elements comprising said sample;

(d) mass analyzing the ions extracted from said chamber; and (e) maintaining at least a part of said wall and/or said sample at a temperature substantially below 20° C.

Preferably the wall and/or the sample should be maintained at about −100° C. or lower, but some advantage is obtained by operation at any temperature lower than 20° C.

In this way it is found that the intensity of background peaks in the glow discharge mass spectrum is substantially reduced in comparison with that obtained using a similar source operating at 20° C. or higher. Background peaks whose formation is related to the presence of water or carbon dioxide are found to be particularly well suppressed. Similarly, the suppression of wanted peaks by water is also substantially reduced. Consequently, the sensitivity of the mass spectrometer is enhanced, especially in respect of those elements the determination of which is badly affected by the presence of water when using a conventional discharge source. Further, the reduction in the concentration of impurities in the glow discharge means that the ions present are more representative of the composition of the sample than those present in prior glow discharge spectrometers, so that a more accurate analysis of the sample can be carried out.

This result is unexpected because from the prior art it would be expected that cooling the ion source according to the invention would result in the transfer into the ion source of relatively large quantities of water vapour which were previously absorbed on parts of the spectrometer vacuum envelope (for example) remote from the discharge, thereby causing an increase, rather than a decrease, in the problems caused by the presence of water vapour in the discharge source. The reason for this unexpected behaviour is not clear, but a possible explanation is that the rate at which frozen water is sputtered by the glow discharge is markedly lower than the sputtering rate of the sample.

Preferably, the first electrode means comprise the wall of the chamber which is typically made of an electrically conducting material such as stainless steel. In the case of an electrically conductive sample, the sample is preferably formed into the second electrode means. A DC glow discharge is then established between the sample and the wall of the chamber with the sample maintained at a negative potential with respect to the wall by application of a suitable potential difference between the first and second electrode means. Typically a current of 1 mA will flow when the potential difference is 1 kV. The gas introduced into the chamber is preferably purified argon, at a pressure between 0.1 and 1.0 torr, but other gases can also be used. As explained, atoms characteristic of the sample are sputtered from the sample cathode and are ionized in the "negative glow" region of the discharge. These ions then leave the source through an exit aperture and enter a mass analyzer.

In the case of an electrically insulating sample, two methods of operation are possible. The sample may be mixed with a conductive powdered material and formed into a solid which can be analysed as described above. Alternatively, the sample may be coated on a conductive support to form a composite second electrode means comprising the sample and support which is then introduced into the mass spectrometer. In this case, the use of an RF discharge, rather than a DC discharge, is preferred.

Obviously, the chamber of the invention must be substantially sealed, with the exception of the gas inlet and the ion exit aperture, in order that the required pressure of argon can be maintained inside it while a vacuum of better than $10^{-4}$ torr is maintained outside it and in the region where the mass analyzer is situated. The vacuum pumps of the mass spectrometer must be of sufficient capacity to maintain the required pressure differential across the ion exit aperture.

Preferably the sample is introduced using an insertion probe and vacuum lock, so that samples can be change without admitting air into the mass spectrometer vacuum envelope. In a preferred embodiment an electrically conducting sample is formed into a rod approximately 10 mm long and 1 mm diameter and is supported in an electrically insulated sample holder on the end of the insertion probe. Contact means are provided to establish an electrical connection between the sample and the negative terminal of the glow discharge power supply and the insulated sample holder is adapted to make a substantially gas tight seal with the wall of the chamber when the probe is fully inserted. The wall itself is connected to the positive terminal of the glow discharge power supply. When a magnetic sector mass analyzer is employed, as is preferred, the wall and the ion exit aperture are floated at the accelerating potential of the mass analyzer, typically +8 kV. Consequently the glow discharge power supply is also floated at this potential, and must be insulated accordingly.

As explained, it is also within the scope of the invention to utilize an RF powered discharge, which is especially useful if the sample to be analyzed is an electrical insulator. Several versions of RF powered glow discharge ion sources have been described.

The glow discharge may also be constrained within a certain region of the chamber by the use of permanent or electro-magnets. A variety of other cathode geometries may also be employed, as explained by Harrison, Hess, Marcus and King, but in general the rod-shaped cathode is preferred.

According to the invention, the temperature of the chamber of the discharge source is maintained substantially below 20° C. by any suitable means. In a preferred embodiment, an electrically insulating member of good thermal conductivity is disposed in thermal contact with the wall of the chamber, and a heat exchanging means is disposed in thermal contact with the insulating member. The heat exchanging means should be capable of transferring heat from the insulating member to a fluid coolant, and means are also provided for causing the coolant to flow through the heat exchanging means. In a yet further preferred embodiment, the chamber is formed in a substantially cylindrical ion source and a copper strip is clamped around its outside diameter. Attached to the strip is a thick ceramic block containing several holes through which a length of copper piping is threaded in the form of a coil. Liquid nitrogen, or another suitable coolant, is circulated through the pipe, thereby cooling the chamber to the preferred value of −100° C. or below while electrical insulation is maintained between the chamber and the copper pipe. Preferably the ceramic block should have a high thermal conductivity and the cooling system should be capable of reducing the temperature of the chamber to below −100° C. in less than 15 minutes, for example. For example, the electrically insulating member may be made of boron nitride.

Preferably also, an electrical heater is fitted to the electrically insulating member. This can be used to rapidly raise the temperature of the chamber to about 20° C. whilst it is under vacuum in order to clean it.

According to another embodiment of the invention, means are also provided for cooling the sample as well as the chamber. By directly cooling the sample, the background mass spectrum and the suppression effect of water can be further reduced. This can be achieved in practice by ensuring that when the probe is fully inserted, good thermal contact is established between the insulated sample holder (fitted to the insertion probe) and the wall of the chamber, and/or by the provision of a second heat exchanging means which is adapted to make good thermal contact with the insulated sample holder when the probe is inserted. The thermal contact is conveniently established through a spring loaded clamp which makes good contact with the insulated sample holder when the insertion probe is inserted. The second heat exchanging means may comprise a cooling coil and insulated member similar to those used for cooling the chamber itself. Because the insulated sample holder is operated at an electrical potential different from that of the chamber, it is preferable that the cooling coils are insulated from the clamps.

Preferably the sample should be maintained at a slightly higher temperature than the remainder of the ion source, for example by providing a cooling device on the insulated sample holder having a lesser cooling effect than that on the chamber or by employing only the cooling device on the chamber and ensuring sufficient thermal resistance between the sample and the chamber.

A preferred embodiment of the invention will now be described in greater detail by way of example and with reference to the figures in which.

Figure 1:
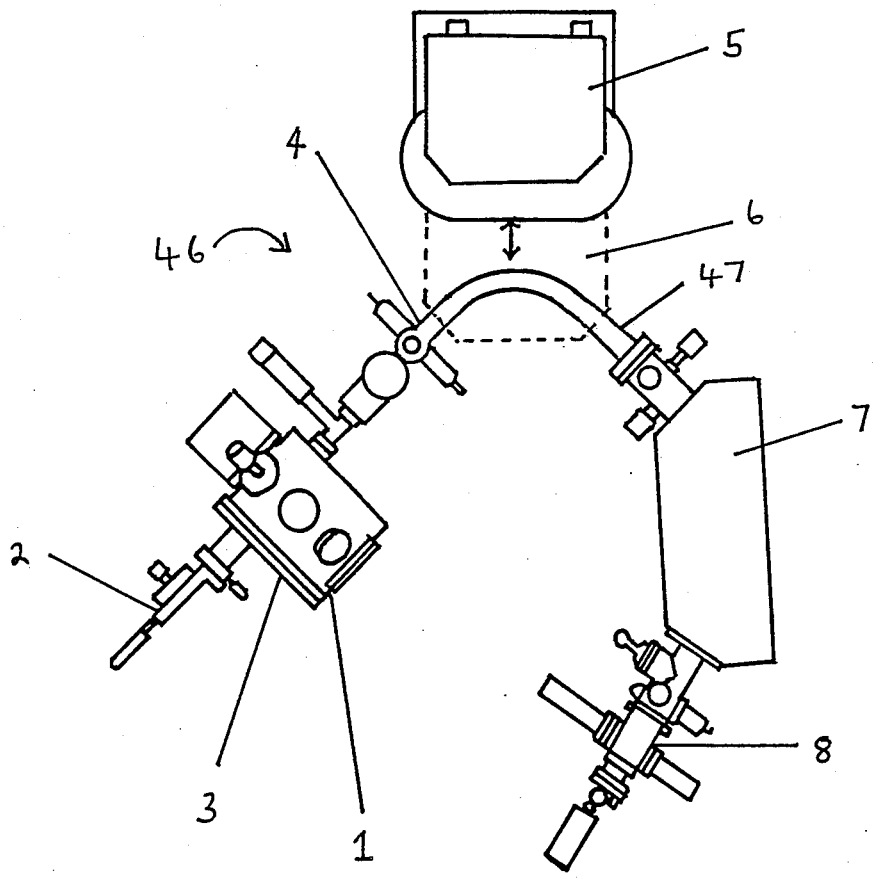
FIG. 1 illustrates a preferred embodiment of the invention incorporating a mass analyzer comprising a double focusing magnetic sector analyzer.

Referring first to FIG. 1, a mass spectrometer 46 comprises a source housing 1 containing the glow discharge ion source which is described in detail below. Means for introducing a solid sample into the ion source, comprising a sample insertion probe assembly 2 mounted on an end flange 3 of housing 1, are provided. Ions formed in the discharge source leave housing 1 and pass through a flight tube 4. Means are provided for mass analyzing these ions, and comprise an electromagnet 5 (shown displaced from its operating position 6 for clarity) which causes the ions travelling in flight tube 4 to travel in circular trajectories with radii dependent on their mass-to-charge ratios. Ions of certain selected mass/charge ratios then enter an electrostatic analyzer contained in housing 7, and finally enter the detector 8. Electromagnet 5 and the electrostatic analyzer comprise a conventional double focusing high resolution mass spectrometer, the construction of which is well known in the art, but it will be appreciated that mass analyzers of different types can be used in the invention if desired.

Figure 2:
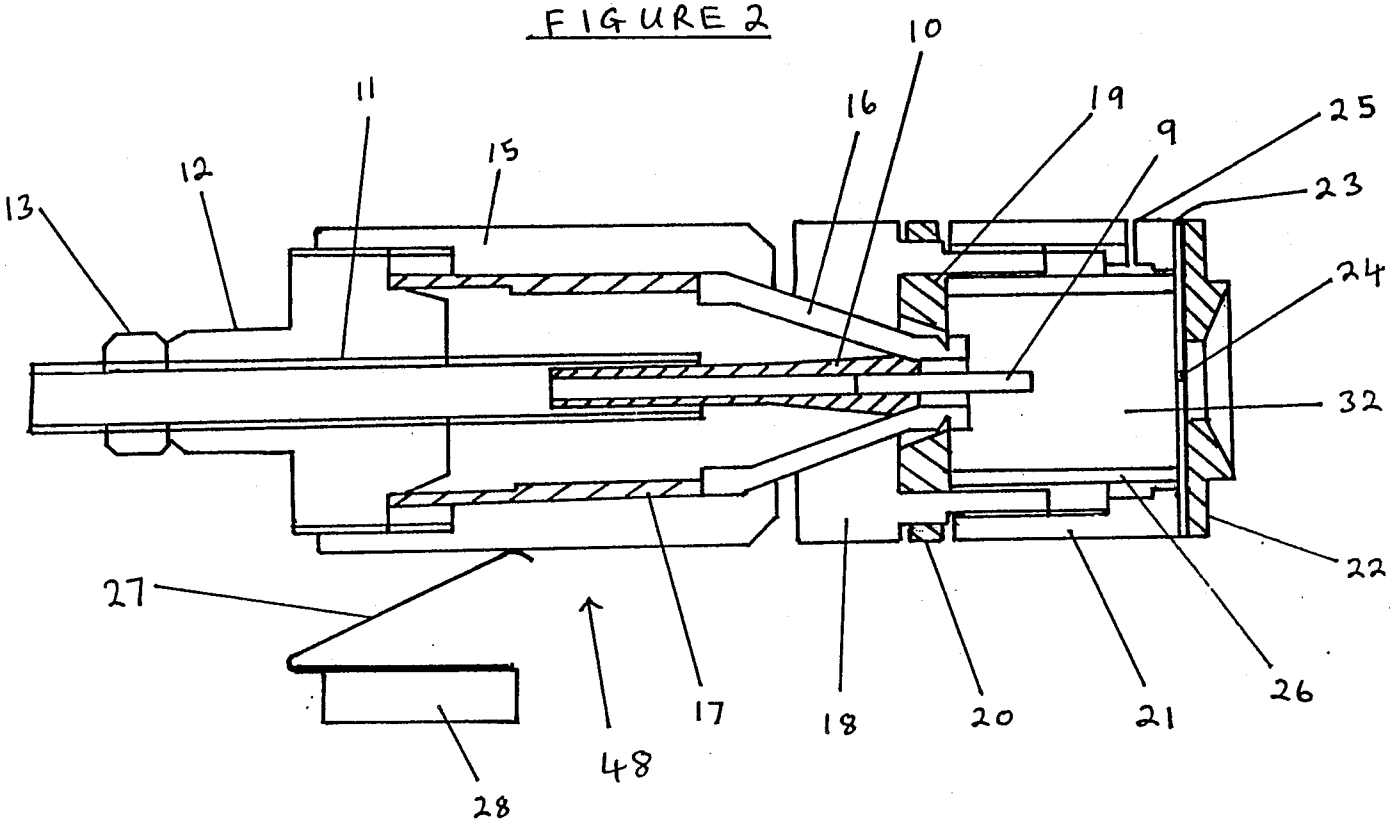
FIG. 2 illustrates in greater detail the sample holder and discharge source of FIG. 1.

Referring next to FIG. 2, a solid sample 9 is made in the form of a solid rod typically 1–2 mm diameter and 10 mm long, and is supported in an electrically insulated sample holder 48 (FIGS. 2 and 4) which is part of the sample insertion probe assembly 2. Sample 9 is gripped by a tantalum pin chuck 10 which is located in a counterbore in the end of an adjusting rod 11, which is externally threaded and screwed into a chuck backplate 12. Locknut 13 secures rod 11 after the desired length has been set by screwing it in or out of backplate 12. Rod 11 is attached to insertion probe shaft 14 (FIG. 4) so that sample 9 can be inserted or withdrawn from the housing 1 without admitting air into vacuum envelope 47. Such insertion probe assemblies are well known in the art.

Chuck backplate 12 is screwed into a chuck bonnet 15 which secures a PTFE cone 16. A cylindrical spacer 17 spaces cone 16 from the backplate 12 as shown in the figure. Pin chuck 10, located in the counterbore in rod 11, is closed so that it grips sample 9 by virtue of the pressure exerted on it by cone 16. Thus, in order to load a sample, locknut 13 is slackened and the adjusting rod 11 unscrewed slightly so that the grip of chuck 10 is released, allowing the sample 9 to be inserted. Rod 11 is then screwed into backplate 12, and secured by locknut 13, closing chuck 10 and gripping the sample 9.

The discharge source itself comprises a substantially enclosed chamber 32 in which the discharge takes place. The wall of chamber 32 comprises items 18, 19, 21, 22, 23 and 26 which are described in detail below.

When shaft 14 is fully inserted, cone 16 mates with an insulated spacer 18 which comprises a conical hole adapted to make a substantially gas tight seal with cone 16, thereby substantially sealing chamber 32. A tantalum ring 19 is located in a counterbore inside spacer 18 and is connected by several radially disposed screws (not shown) to an annular contact ring 20 on the outside of spacer 18. A stainless steel end cap 21 is screwed on to spacer 18, and an end plate 22 is attached to it by three screws (not shown). Means are provided for extracting at least some of the ions formed in the discharge in chamber 32 and comprise an aperture 24 in slit member 23 which is sandwiched between end cap 21 and end plate 22. Aperture 24 is preferably a rectangular slit approximately $0.1 \times 6$ mm.

End cap 21 also contains a narrow-bore gas inlet 25 through which a discharge gas is introduced into the ion source. A cylindrical quartz liner 26 is positioned inside end cap 21.

Figure 4:
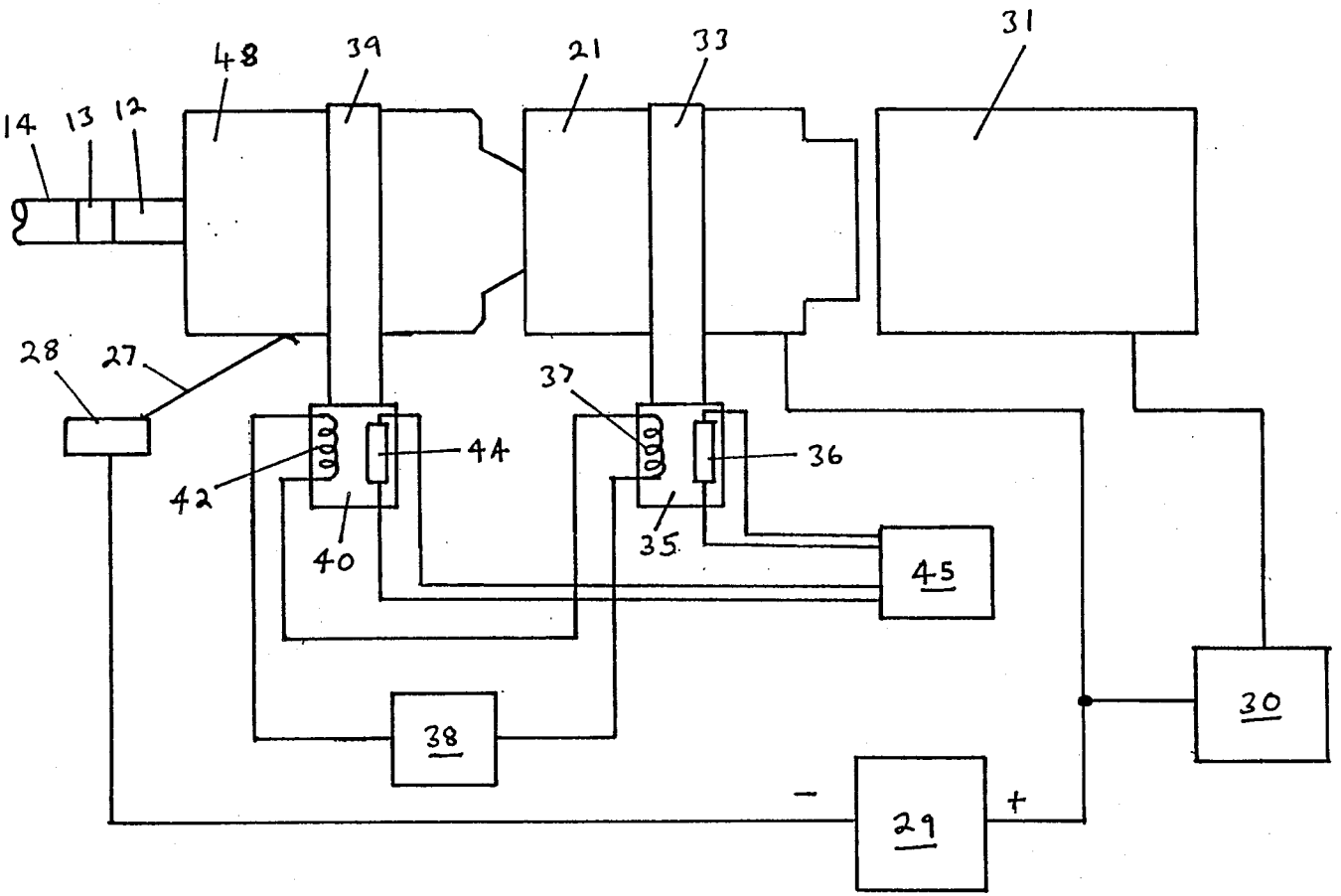
FIG. 4 shows the interconnection of certain parts of the embodiment shown in FIG. 1.

A first electrode means (anode) which is part of the wall of chamber 32 is provided and comprises end plate 22, slit member 23, end cap 21 and tantalum ring 19. These components are maintained at the accelerating voltage of the mass analyzer, typically +8 kV for a double focusing high resolution spectrometer. A second electrode means (cathode) is also provided and comprises the sample 9 which is maintained approximately 0.5–1.0 kV less positive than the anode by virtue of its contact with chuck 10, rod 11, backplate 12 and bonnet 15. A contact spring 27, mounted on an insulated contact mounting block 28, is disposed to make good contact with bonnet 15 when the insertion probe shaft 14 is fully inserted. Means for establishing a glow discharge are also provided and comprise glow discharge power supply 29, capable of delivering up to 10 mA at a potential difference of up to 1 kV and connected as shown in FIG. 4 between the contact 27 and the end cap 21. A mass analyzer power supply and controller 30 generates the accelerating potential required by the analyzer and is connected to end cap 21. Consequently, power supply 29 floats at this voltage and must be insulated accordingly. Controller 30 also generates all the potentials necessary for the proper operation of the mass analyzer 31 which is shown schematically in FIG. 4 and comprises items 5, 7 and 8 of FIG. 1.

A high purity discharge gas, typically argon, is introduced through inlet 25 into the chamber 32 at a pressure of approximately 1 torr, so that a DC glow discharge is formed between the anode and cathode electrodes described above. A current of 1 mA is typical for argon at 1 torr and a potential difference of 1 kV, but the voltage and current are dependent on the conditions in the ion source. As explained, the discharge results in the formation of ions characteristic of the elements in sample 9. These exit through aperture 24 and are mass analyzed by analyzer 31 in a conventional way.

Although a DC discharge is preferred it is also within the scope of the invention to use an RF sustained discharge. In this case, discharge power supply 29 will comprise a suitable RF generator.

During operation of the source, material sputtered from sample 9 may be deposited on the walls enclosing the discharge region, and quartz liner 26 is provided to facilitate cleaning the ion source. Liner 26 can be removed from the source after end plate 22 has been removed, and can be cleaned or replaced as required. In this way, interference with an analysis by material remaining in the source from a previous analysis can be prevented.

Figure 3B:
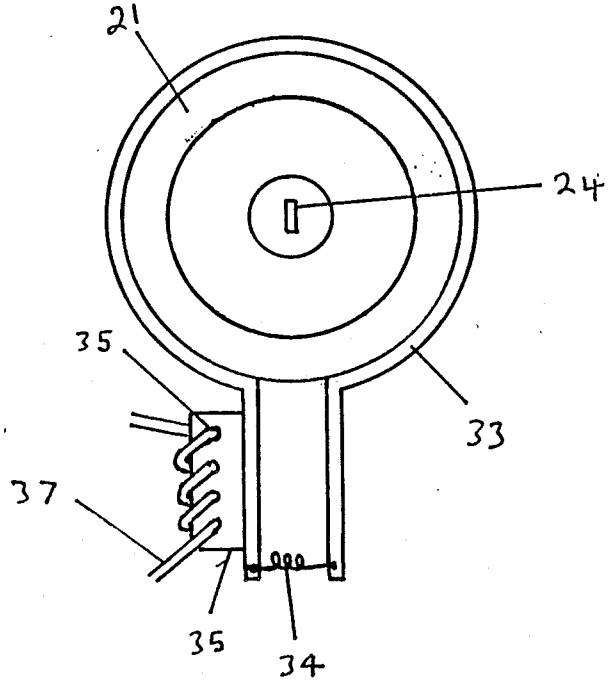
FIGS. 3A and 3B illustrate a cooled clamp suitable for use with the discharge source illustrated in FIG. 2.
Figure 3A:
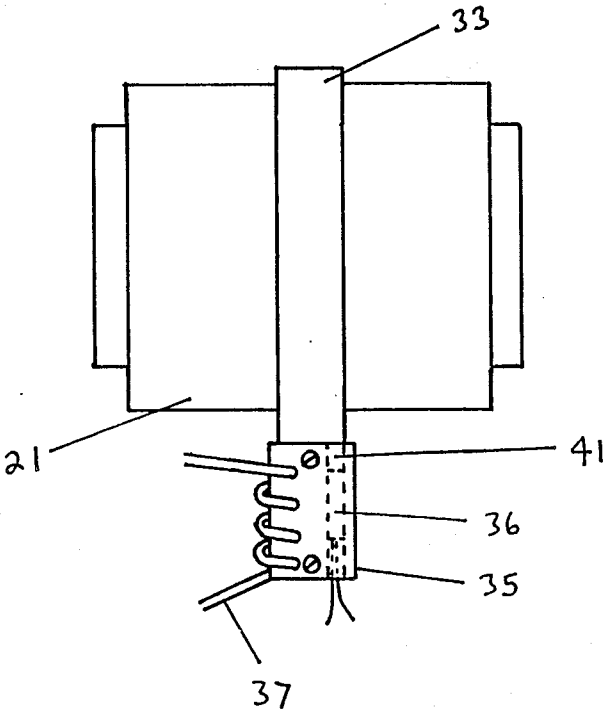

Referring next to FIGS. 3A, 3B and 4, means for maintaining at least chamber 32 at a temperature substantially below 20° C are provided. These comprise a first heat exchanging means (items 33, 35 and 37, described below) and refrigeration/pump means 38 which causes liquid coolant to flow through the first heat exchanging means. In a preferred embodiment, a clip 33, preferably fabricated from a copper strip, is held in good thermal contact with part of the wall of chamber 32 (end cap 21) by means of a tension spring 34. An electrically insulating member 35 is attached to clip 33 and comprises several holes through which a pipe 37 is threaded in the form of a coil. Member 35 also contains a cylindrical hole in which an electrical heater 36 is fitted in good thermal contact with it. A coolant typically cold nitrogen gas or liquid nitrogen, is passed through pipe 37 by means of a refrigeration/pump means 38, so that end cap 21 is cooled by thermal conduction through clip 33 and member 35. This arrangement enables the temperature of the ion source to be reduced to and maintained at a value substantially less than 20° C., despite the heat generated by the discharge. Preferably, the refrigerant and the refrigeration/pump means should be such as to allow the source to operate at −100° C. or lower.

Member 35 is preferably made from a ceramic material having a high thermal conductivity, e.g. from boron nitride, thereby providing electrical insulation between the cooling system and the high potential applied to end cap 21.

Insulated sample holder 48 may also be cooled by a similar arrangement. A spring loaded clip 39 is adapted to make good thermal contact with bonnet 15 when the sample 9 is positioned in the source. Another electrical insulating block 40 (FIG. 4) is attached to clip 39 and pipe 42 is threaded through holes in it. Refrigerant is also passed through pipe 42, thereby cooling the chuck bonnet 15, and sample 9 by virtue of thermal conduction through chuck 10, rod 11 and backplate 12. A second heating element 44 is located in a hole in block 40. Alternatively, the sample 9 may be cooled by good thermal contact between the sample holder 48 and the wall of chamber 32. If insulated spacer 18 and cone 16 are fabricated from a material having a high thermal conductivity, bonnet 15, and hence sample 9, will be cooled by thermal conduction through cone 16 and spacer 18 to end cap 21.

Preferably sample 9 should be maintained at a slightly higher temperature than the remainder of the ion source. This is easily achieved in practice because heat is transmitted to it by the sputtering process due to the discharge, and there is bound to be a thermal resistance between the sample and the parts of the source which are directly cooled.

Heating elements 36 and 44, powered by heater supply unit 45, are provided to allow the temperature of the sample and ion source to be rapidly raised to room temperature after a period of operation at low temperature. Thus condensation of materials in the atmosphere on the sample and/or source components can be avoided when air is admitted to housing 1 (or when the sample holder is withdrawn to change a sample) by ensuring that the temperature of the source is at least room temperature before air is admitted. The heating elements may also be used to bake the ion source in a vacuum to a temperature of 200° C. or higher in order to clean it.

Temperature monitoring means such as thermocouples are installed at least on clips 33 and 39 and on end cap 21, so that the operating temperature of the source can be measured.

Preferably the coolant used in the invention is cold gaseous nitrogen or liquid nitrogen or helium. This is circulated through pipes 37 and 42 at a flow typically of several ml/minute, and allows a temperature of −100° C. to be achieved within typically 15 minutes. Refrigeration/pump means 38 incorporates a heat exchanger and a circulating pump, but if a liquid coolant is employed, this may be caused to flow simply by means of gravity from a suitably placed storage vessel, and pump means 38 is then not required. Any suitable conventional refrigeration or cooling system can be used.

Referring to FIG. 4, it will be appreciated that the refrigeration/pump means 38 and the power supplies 45, 29 and 30 are located outside the vacuum envelope 47 which encloses the source and mass analyzer. The connections between these units and parts contained inside the vacuum are therefore taken through suitable conventional high vacuum feedthroughs (not shown) mounted on the envelope.

Figure 5A:
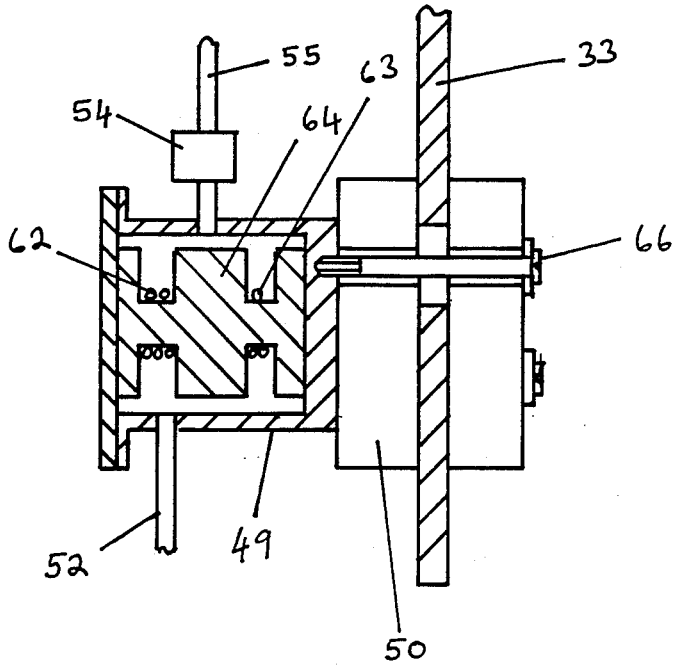
FIGS. 5A and 5B show an alternative means for cooling the discharge source of FIG. 2.

In an alternative and more preferred embodiment (FIGS. 5A and 5B), a more efficient heat exchanger especially suitable for use with a liquid nitrogen coolant may be provided.

In this embodiment, a heat exchanger 49 is attached by three bolts 66 to clip 33 and an electrically insulated member 50 of good thermal conductivity.;Liquid nitrogen stored in a closed insulated reservoir 51 flows through a thermally insulated pipe 52 into exchanger 49 by virtue of the pressure of gas in reservoir 51 created by evaporation of some of the liquid nitrogen. Pipe 52 passes through a vacuum tight feedthrough 53 in the mass spectrometer vacuum envelope 47. Heat conducted through clip 33 and member 50 causes the vaporization of at least some of the liquid nitrogen in exchanger 49, thereby reducing its temperature, typically to less than −100° C. Vaporized nitrogen and any remaining liquid escape from exchanger 49 via a pressure reducing valve 54 into an outlet pipe 55 which passes through feedthrough 56, flowmeter 57 and a flow regulating needle valve 58 which can be adjusted to control the flow of nitrogen, and therefore the temperature of exchanger 49. For the maximum speed of cooling, a valve 59 is opened to bypass needle valve 58. A safety valve 60 and pressure gauge 61 are also provided, as shown in FIG. 5B.

A heater 62 and a thermocouple 63 are wound on an insulated bobbin 64 disposed inside exchanger 49. Heater 62 is used for the same purposes as heater 36 in the FIG. 4 embodiment, and is controlled in a similar way. Thermocouple 63 is used to monitor the temperature inside heat exchanger 49.

Figure 5B:
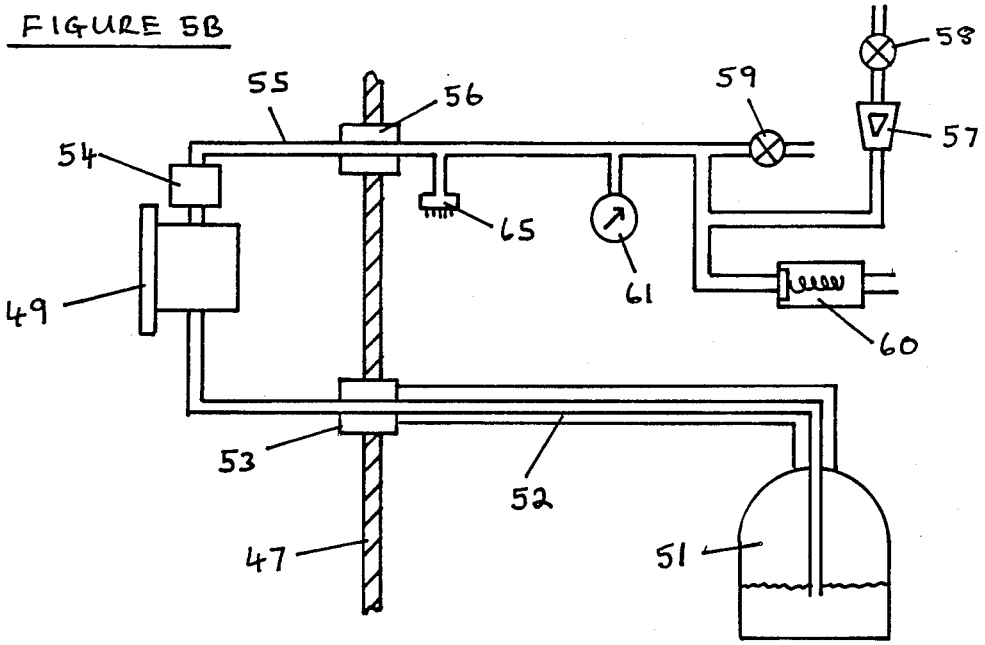

The electrical connections to heater 62 and thermocouple 63 are threaded through pipe 55 and are brought out to a sealed plug 65 on pipe 55 at a point outside the vacuum envelope 47, as shown in FIG. 5B.

A similar heat exchanger and its associated components may be provided on clip 39, but it is preferable to cool the sample 9 by thermal conduction through sample holder 48 and the wall of chamber 32, as explained.

We claim:

1. In a glow discharge mass spectrometer for the elemental analysis of a sample, the spectrometer having a vacuum envelope, an improved ion source operatively associated with said envelope comprising:

(a) means defining a substantially closed chamber bounded by a wall which is separate from the spectrometer envelope, said chamber having an inlet through which a gas may be introduced at a pressure greater than that established in the spectrometer envelope and an aperture through which ions formed within said chamber may exit into the spectrometer envelope;

(b) means for introducing a solid sample into said chamber (c) first electrode means disposed in said chamber remote from the sample;

(d) means for establishing a glow discharge in said chamber between said first electrode means and the sample, the sample at least in part comprising a second electrode means;

(e) means for extracting from said chamber via said aperture for subsequent mass analysis at least some of the ions formed in said glow discharge which are characteristic of elements in the sample; and (f) means for maintaining at least part of said chamber wall and/or the sample at a temperature below the freezing point of water.

2. The mass spectrometer to claim 1 in which said means for maintaining temperature comprises:

(a) an electrically insulating member disposed in heat exchange contact with said chamber wall;

(b) first heat exchanging means disposed in contact with said insulating member for transferring heat from said insulating member to a fluid coolant; and (c) means for causing said coolant to flow through said first heat exchanging means.

3. The mass spectrometer according to claim 2 in which said coolant is liquid nitrogen and said temperature is less than about −100° C.

4. The mass spectrometer of claim 1 wherein:

(a) said first electrode means comprises at least a part of the wall which defines said chamber;

(b) said means for establishing a glow discharge maintains the sample at a negative potential with respect to said first electrode means, and (c) said sample introducing means comprises insertion probe means introducing the sample into said chamber without admitting air into the spectrometer envelope, said probe means include an electrically insulated holder for supporting the sample.

5. The mass spectrometer according to claim 1 in which thermal contact between said means for introducing a solid sample and said chamber wall is provided for cooling the sample.

6. The mass spectrometer according to claim 2 further comprising a second heat exchanging means wherein the sample is cooled by establishing thermal contact between said means for introducing a solid sample and said second heat exchanging means.

7. The mass spectrometer according to claim 2 further comprising a heater positioned in a heat exchange relationship with said electrically insulating member.

8. The mass spectrometer according to claim 1 in which said temperature is less than about −100° C.

9. The mass spectrometer according to claim 4 in which said temperature is less than about −100° C.

10. The mass spectrometer according to claim 5 in which said temperature is less than about −100° C.

11. The mass spectrometer according to claim 6 in which said temperature is less than about −100° C.

12. A method for the elemental analysis of a sample in an elevator having a vacuum envelope, said method comprising the steps of:

(a) introducing said sample into a chamber, the chamber being bounded by a wall which is separate from the analyzer envelope, the chamber containing a gas at a pressure greater than that established in the analyzer envelope;

(b) establishing a glow discharge in said chamber adjacent to said sample and causing particles present in said discharge to bombard said sample;

(c) extracting from said chamber at least some of the ions formed in said discharge which are characteristic of elements comprising said sample;

(d) mass analyzing the ions extracted from said chamber; and (e) maintaining at least a part of said wall and/or said sample at a temperature below the freezing point of water,

13. A method of elemental analysis according to claim 12 in which at least a part of said wall and/or said sample is maintained at a temperature below about −100° C.

* * * * *

UNITED STATES PATENT AND TRADEMARK OFFICE

CERTIFICATE OF CORRECTION

PATENT NO. : 4,853,539

DATED : August 1, 1989

INVENTOR(S) : D. J. Hall et al

It is certified that error appears in the above-identified patent and that said Letters Patent is hereby corrected as shown below:

Claim 2, line 1, after "spectrometer" insert -- according --.

Claim 12, line 2, "elevator" should be -- analyzer --.

Signed and Sealed this

Thirty-first Day of July, 1990

*Attest:*

HARRY F. MANBECK, JR.

*Attesting Officer*

*Commissioner of Patents and Trademarks*